US009698495B2

(12) United States Patent
Sharawi et al.

(10) Patent No.: US 9,698,495 B2
(45) Date of Patent: Jul. 4, 2017

(54) RECONFIGURABLE MIMO AND SENSING ANTENNA SYSTEM

(71) Applicant: KING FAHD UNIVERSITY OF PETROLEUM AND MINERALS, Dhahran (SA)

(72) Inventors: Mohammad Said Sharawi, Dhahran (SA); Rifaqat Hussain, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 95 days.

(21) Appl. No.: 14/873,171

(22) Filed: Oct. 1, 2015

(65) Prior Publication Data

US 2017/0098897 A1 Apr. 6, 2017

(51) Int. Cl.

| | |
|---|---|
| ***H01Q 9/00*** | (2006.01) |
| ***H01Q 21/28*** | (2006.01) |
| ***H01Q 5/314*** | (2015.01) |
| ***H01Q 5/20*** | (2015.01) |

(52) U.S. Cl.
CPC ..... *H01Q 21/28* (2013.01); *H01Q 5/20* (2015.01); *H01Q 5/314* (2015.01)

(58) Field of Classification Search
CPC ..... H01Q 21/12; H01Q 9/42; H01Q 11/02; H01Q 3/26; H01Q 1/243
USPC ..... 343/751, 893, 876, 879
See application file for complete search history.

(56) References Cited

U.S. PATENT DOCUMENTS

| | | | | |
|---|---|---|---|---|
| 7,348,928 | B2 | 3/2008 | Ma et al. | |
| 2006/0262015 | A1 * | 11/2006 | Thornell-Pers ..... | H01Q 1/243 343/702 |
| 2013/0273858 | A1 | 10/2013 | Sover et al. | |
| 2013/0307742 | A1 | 11/2013 | Hu et al. | |

FOREIGN PATENT DOCUMENTS

WO WO 2014/110508 A1 7/2014

* cited by examiner

*Primary Examiner* — Dameon E Levi
*Assistant Examiner* — Collin Dawkins
(74) *Attorney, Agent, or Firm* — Richard C. Litman

(57) ABSTRACT

The reconfigurable MIMO and sensing antenna system combines a 2-element reconfigurable MIMO antenna system with a UWB element. The complete setup is suitable for CR platforms that require sensing UWB band availability. The design is planar in structure and includes a pair of PIFAs disposed on a dielectric substrate top surface. The UWB sensing element is disposed on the dielectric substrate bottom surface. An F-head portion of each PIFA has two arms extending to a longer peripheral edge of the substrate. An F-tail portion of each PIFA extends from the substrate's shorter peripheral edge. The two PIFAs are mirror images of each other. For each PIFA, three diode circuits include a PIN diode in combination with a varactor diode connected to and extending away from the F-tail portion of the PIFA, thereby creating separate radiating branches of the PIFA.

9 Claims, 14 Drawing Sheets

800b

800c

RECONFIGURABLE MIMO AND SENSING ANTENNA SYSTEM

BACKGROUND OF THE INVENTION

1. Field of the Invention

The present invention relates to multi-band wireless communication systems, and particularly to a reconfigurable MIMO and sensing antenna system that has a two-element reconfigurable antenna and a ground plane serving as an ultra-wide band (UWB) sensing element for use in compact wireless devices and LTE mobile handsets. The complete setup can be used in radio frequency-based applications, including 4G cellular systems.

2. Description of the Related Art

In modern wireless communications, the exponential growth of wireless services results in an increasing demand of the data rate requirements and reliability of data. These services may include high-quality audio/video calls, online video streaming, video conferencing and online gaming. These demanding features may require wide bandwidth operation or covering operation across several frequency bands. This provides motivation for comprehensive and efficient utilization of the available spectrum. The effort to overcome inefficient and highly underutilized spectrum resources has led to concept of cognitive radio (CR). A CR system is based on structural design of software-defined radio intended to enhance spectrum utilization efficiency by interacting with the operating environment. A CR-based system must be aware of its environment by sensing spectrum usage and have the capability to switch over the operating points among different unoccupied frequency bands. A CR-based system may cover various features, including sensing the spectrum of nearby devices, switching between different frequency bands, and power level adjustment of transmitting antennas, Reconfigurable antennas are able to change their operating fundamental characteristics, e.g., resonance frequency, radiation pattern, polarization and impedance bandwidth. A frequency reconfigurable antenna is an essential component of CR platforms. An attractive feature of such an antenna is its switching across several frequency bands by activating different radiating parts of the same antenna. Reconfigurability is the fundamental requirement for CR platforms. CR-based systems are capable of switching the frequency bands of a single frequency reconfigurable antenna over different bands to efficiently and inclusively utilize idle spectrum.

To achieve the desired characteristics of reconfigurability and desired performance of a MIMO antenna system, several challenges need to be overcome. These issues include the size of the antennas for low frequency bands; a requirement of high isolation between closely spaced antennas; and control circuitry embedded within the given antenna to achieve the desired reconfiguration. Moreover, the performance of the MIMO system degrades significantly for closely spaced antennas due to high mutual coupling.

Thus, a reconfigurable MIMO and sensing antenna system solving the aforementioned problems is desired.

SUMMARY OF THE INVENTION

The reconfigurable MIMO and sensing antenna system is a 2-element reconfigurable MIMO antenna system including a UWB element. The complete setup is suitable for CR platforms that require sensing UWB band availability. The design is planar in structure and includes a pair of PIFAs (planar inverted-F antennas) disposed on a dielectric substrate top surface. The UWB element is disposed on the dielectric substrate bottom surface. The F-shaped head portion of the PIFA includes two arms extending to a longer peripheral edge of the substrate. The tail portion of the PIFA extends from the substrate's shorter peripheral edge. The two PIFAs are mirror images of each other. For each PIFA, three diode circuits, including a PIN diode in combination with a varactor diode, connect to and extend away from a unique location on the F tail portion of the PIFA, thereby creating separate radiating branches of the PIFA.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
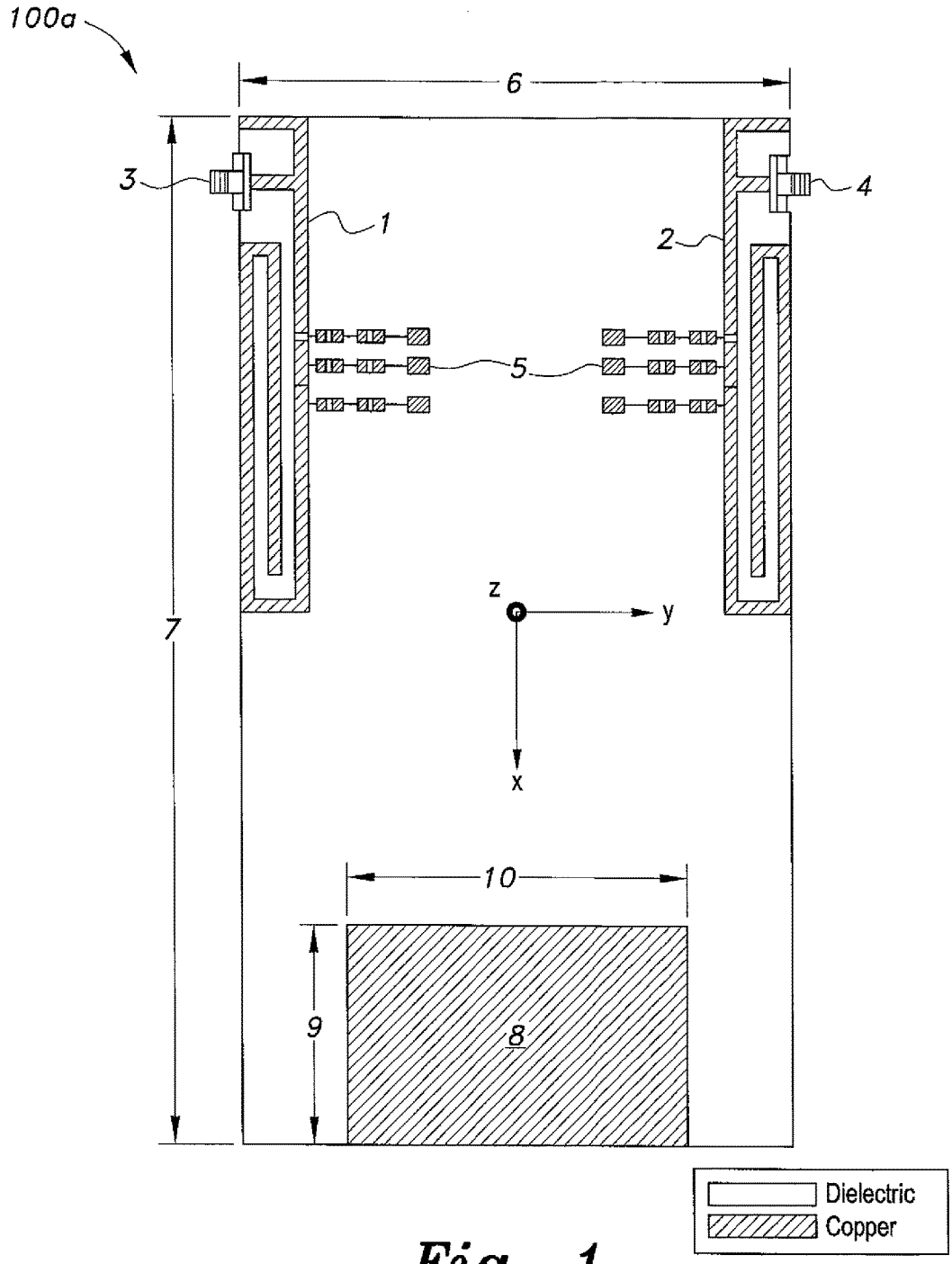
FIG. 1 is a plan view showing the top layer of a printed circuit board (PCB) containing two inverted-F shape (PIFA) radiating elements of a reconfigurable MIMO and sensing antenna system according to the present invention.
Figure 2:
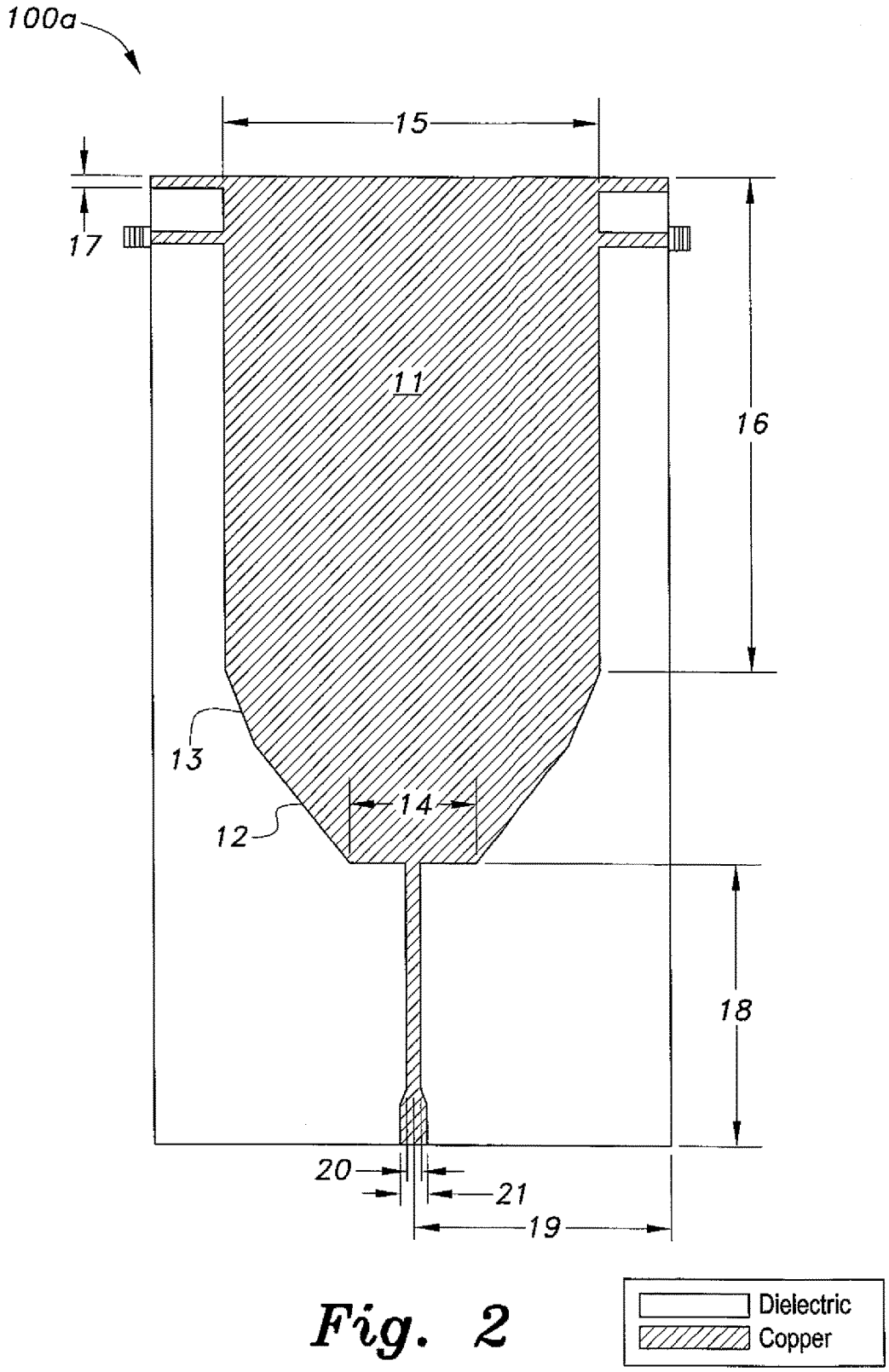
FIG. 2 is a bottom view of the printed circuit board of FIG. 1, showing a ground plane/UWB sensing element of the antenna system.

Features of the reconfigurable MIMO and sensing antenna system are shown in FIGS. 1, 2 and 3. ANSYS® Professional software high frequency structural simulator (HFSS™) is used to observe the reflection response and the radiation properties of the antenna system. A reconfigurable MIMO antenna system having two Planar Inverted-F antennas (PIFA) and a UWB sensing element is provided. The complete setup is suited for CR platforms, which require the capacity to sense UWB band availability. The design is planar in structure and includes a pair of PIFAs disposed on a dielectric substrate top surface. The UWB element is disposed on the dielectric substrate bottom surface, and also acts as a reference ground plane for the reconfigurable PIFAs.

The antenna system has a planar structure and is capable of operation at lower frequency bands starting from 580-680 MHz and 834-1120 MHz by using varactor diode tuning.

The Planar Inverted-F antenna (PIFA) is common in cellular phones (mobile phones) having built-in antennas. The PIFA MIMO antennas of the present antenna system are shown as reconfigurable antennas (1, 2). The two radiating or conducting (exemplary copper) PIFA elements 1 and 2 are disposed on the top surface of the rectangular dielectric substrate (e.g., a printed circuit board) shown. For each PIFA, an F head portion of the PIFA is formed by two arms extending to the longer peripheral edge (the edge having dimension 7) of the rectangular dielectric substrate. The F tail portion of the PIFA extends from the shorter peripheral edge (the edge having dimension 6) of the rectangular dielectric substrate. The first PIFA 1 and the second PIFA 2 are mirror images of each other. A meander pattern of conducting (copper) material extends from a bottom region of the F tail portion of the PIFAs. The given antenna elements 1, 2 are fed by SubMiniature version A (SMA) RF coaxial connectors 3 and 4, respectively. For each PIFA, the SMA feed connector is connected to the F-head portion arm that is most distal from the shorter peripheral edge (the edge having dimension 6). The reconfigurable MIMO antennas 1, 2 are fabricated on the dielectric substrate FR-4 with $\in_r$=4.4 and height 1.56 mm.

For each PIFA, three diode circuits 5, each comprising a PIN diode in combination with a varactor diode, connect to and extend away from a unique location on the F-tail portion of the PIFA, thereby creating separate radiating branches of the PIFA. The UWB element 11 is disposed on the dielectric substrate bottom surface, thus providing a unique architecture of its UWB sensing antenna and reconfigurable MIMO antennas that share the same substrate. The reference GND plane 11 of the reconfigurable MIMO antennas is optimized to work as a sensing antenna to scan the frequency spectrum, while also operating as a GND reference plane for the reconfigurable MIMO antennas during the communication stage.

A positive-intrinsic-negative (PIN) diode is a diode with a wide, undoped intrinsic (I) semiconductor region between a P-type semiconductor and an N-type semiconductor region. For each PIFA 1, 2, three PIN and varactor biasing circuits 5 are used. Each diode circuit is disposed on the dielectric substrate's top surface, connecting to and extending away from a unique location on the F-tail portion of the PIFA 1, 2, thereby creating separate radiating branches of the PIFA 1, 2. For the present design, reconfigurability is achieved by using PIN diodes to switch the diode circuits across the PIFA radiating branches, while fine tuning is achieved by using variable capacitance (varactor) diodes. The two-element reconfigurable antenna is fabricated on a single substrate area of dimensions 6, 7, which may be approximately 65×120 mm$^2$, as shown.

The UWB sensing antenna 11 is fabricated on the bottom side of the board (dielectric substrate), as shown in FIG. 2. The rectangular GND plane 8 of the UWB sensing antenna 11 is fabricated on the top side of the substrate and has dimensions 9, 10, shown with exemplary values of 25×40 mm$^2$. The UWB sensing antenna 11 is basically a monopole antenna having an irregular octagonal shape, and which also serves as a reference GND plane for the reconfigurable antennas 1, 2. The various dimensions of the UWB sensing monopole antenna 11 are given as first side pair dimension 12 (19.21 mm), second side pair dimension 13 (9.87 mm), seventh side dimension 14 (39 mm), eighth side dimension 15 (16 mm), third side pair dimension 16 (60.97 mm), horizontally extending elongate strip width dimension 17 (1.48 mm), vertically extending elongate strip length dimension 18 (34.8 mm), vertically extending elongate strip centerline to PCB board edge dimension 19 (32.5 mm), vertically extending elongate strip width dimension 20 (1.5 mm), and vertically extending elongate strip pad width dimension 21 (3 mm).

Figure 3A:
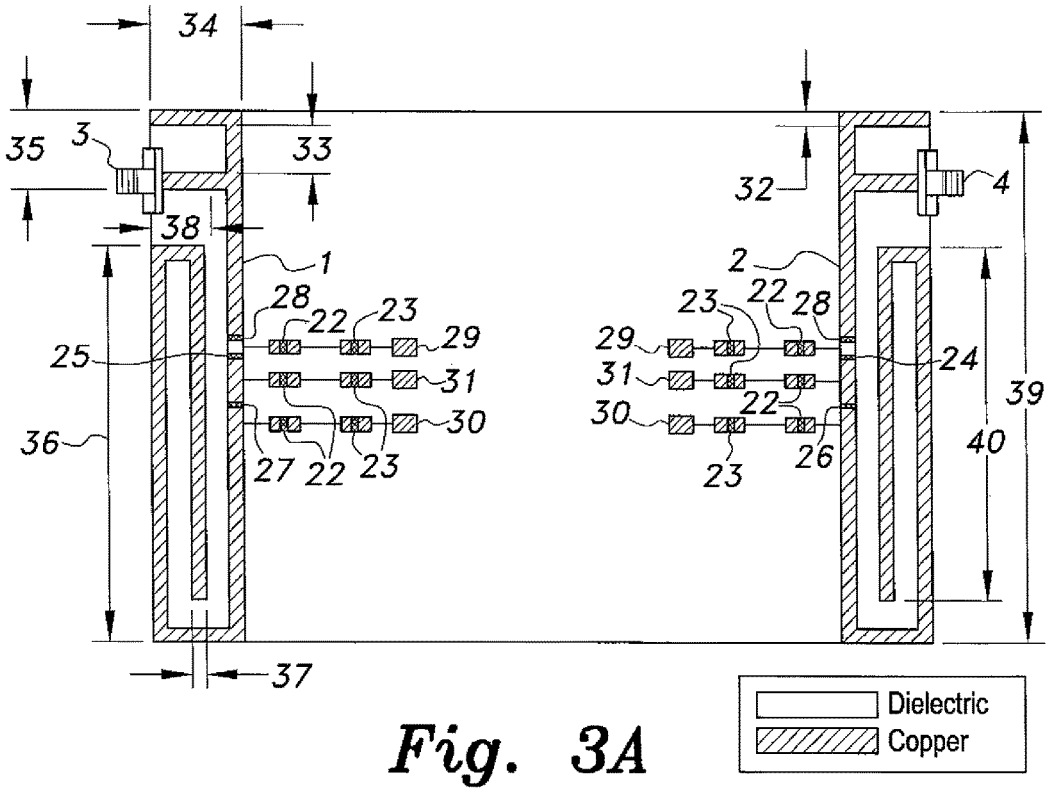
FIG. 3A is a partial top view of the PCB board of FIG. 1, showing the PIFA radiating elements in greater detail.
Figure 3B:
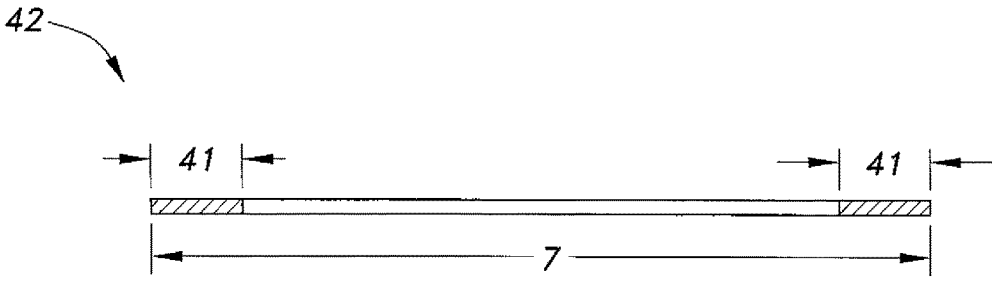
FIG. 3B is a side view of a substrate edge of the antenna circuit, showing the shorting elements of the PIFA antennas.

FIGS. 3A and 3B show detailed views of the two PIFA antenna elements 1, 2, with details of the associated digital circuitry 5 of FIG. 1. FIG. 3A shows the top view illustrating PIN and varactor diode biasing circuitry, which includes PIN and varactor diodes having similar biasing circuitry, which comprises a 1 pH RF choke 22 in series with a 2.1 kΩ resistor 23 connected to a conducting terminal pad 29, 30, 31. PIN diodes 24 and 25 are disposed in the PIFAs F-tail portion and are used for switching across the radiating branches for the two antennas 1 and 2. Varactor diodes 26 and 27 are disposed in the PIFAs F-tail portion and are used by the two antennas for fine tuning. V, is +5V applied at pad 29, while pad 31 serves as a digital reference GND, Fixed+5V is applied to PIN diodes 24 and 25, while variable voltage is applied at pad 30 to bias the varactors 26 and 27 for introducing variable capacitance in the radiating slot of the reconfigurable antenna system 100*a*. The two reconfigurable antennas 1 and 2 are exactly similar in structure. DC blocking capacitors 28 are disposed in the PIFAs F-tail portion and are connected across each branch as coupling capacitors. The dimensions of different radiating parts of top layers of the PIFA antennas are PIFA strip width 32 (1.48 mm), PIFA element separation distance 33 (5.44 mm), PIFA element length 34 (7.9 mm), distance 35 between centerline of SMA connector and top of top arm of F-head portion of the PIFA (8.4 mm), board edge adjacent long meander line length 36 (50.88 mm), meander line width 37 (1.48 mm, third meander line length 38 (4.98 mm), F-tail portion total length 39 (58.07 mm), fourth meander line length 40 (38.96 mm) and first meander line length 41 (8 mm), as shown in FIG. 3B along the long edge 42 of the dielectric substrate (PCB board).

Figure 4:
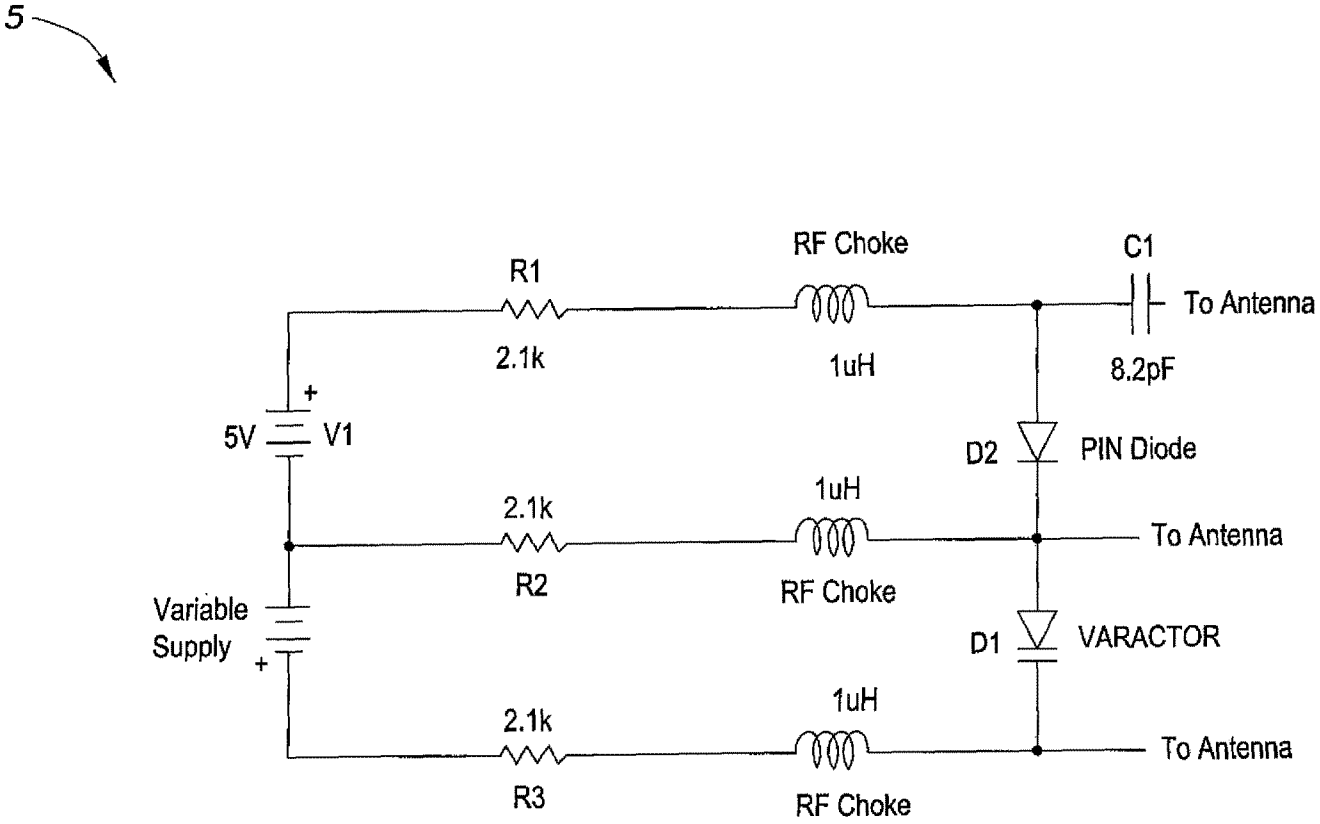
FIG. 4 is a schematic diagram of a bias circuit for a single one of the PIFA elements of FIG. 1.

As shown in FIG. 4, the biasing (PIFA diode) circuit 5 comprises a first loop and a second loop. The first loop of the PIFA diode circuit 5 includes a first fixed resistance in series with a first fixed radio frequency (RF) choke connected to an anode of the PIN diode D2. A second fixed resistance is in series with a second fixed radio frequency (RF) choke, which is connected to a cathode of PIN diode D2. A fixed DC voltage has its positive terminal connected to the first fixed resistance and its negative terminal connected to the second fixed resistance, thereby closing the first loop. With respect to the second loop, the second fixed resistance, which is in series with the second fixed radio frequency (RF) choke, is connected to an anode of the varactor diode D1. A third fixed resistance is in series with a third fixed radio frequency (RF) choke, which is connected to a cathode of the varactor diode D1. A variable DC voltage has its positive terminal connected to the third fixed resistance and its negative terminal connected to the second fixed resistance, thereby closing the second loop.

Figure 7:
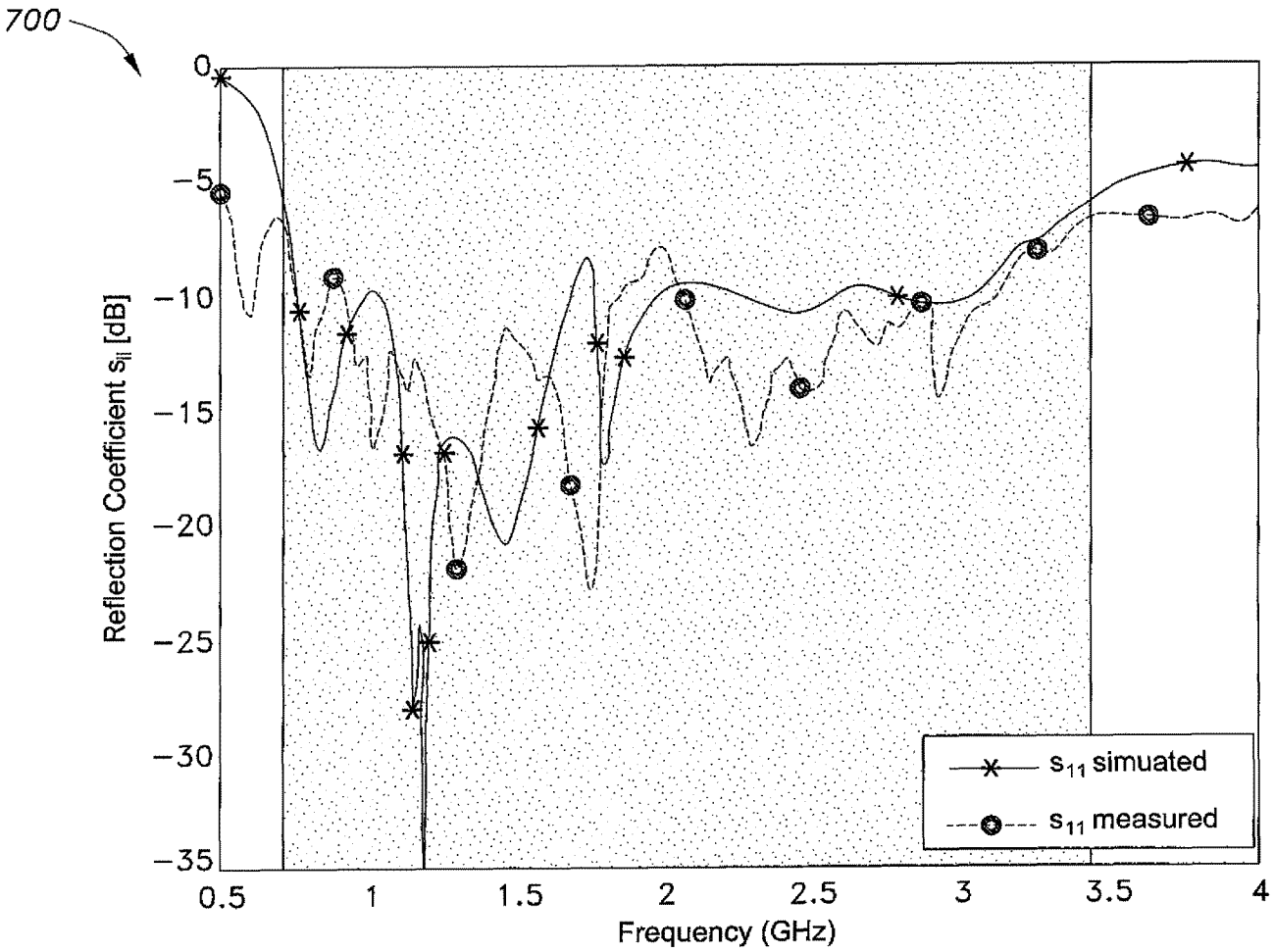
FIG. 7 is a plot showing simulated and measured reflection coefficients for the UWB sensing antenna of a reconfigurable MIMO and sensing antenna system according to the present invention.
Figure 8A:
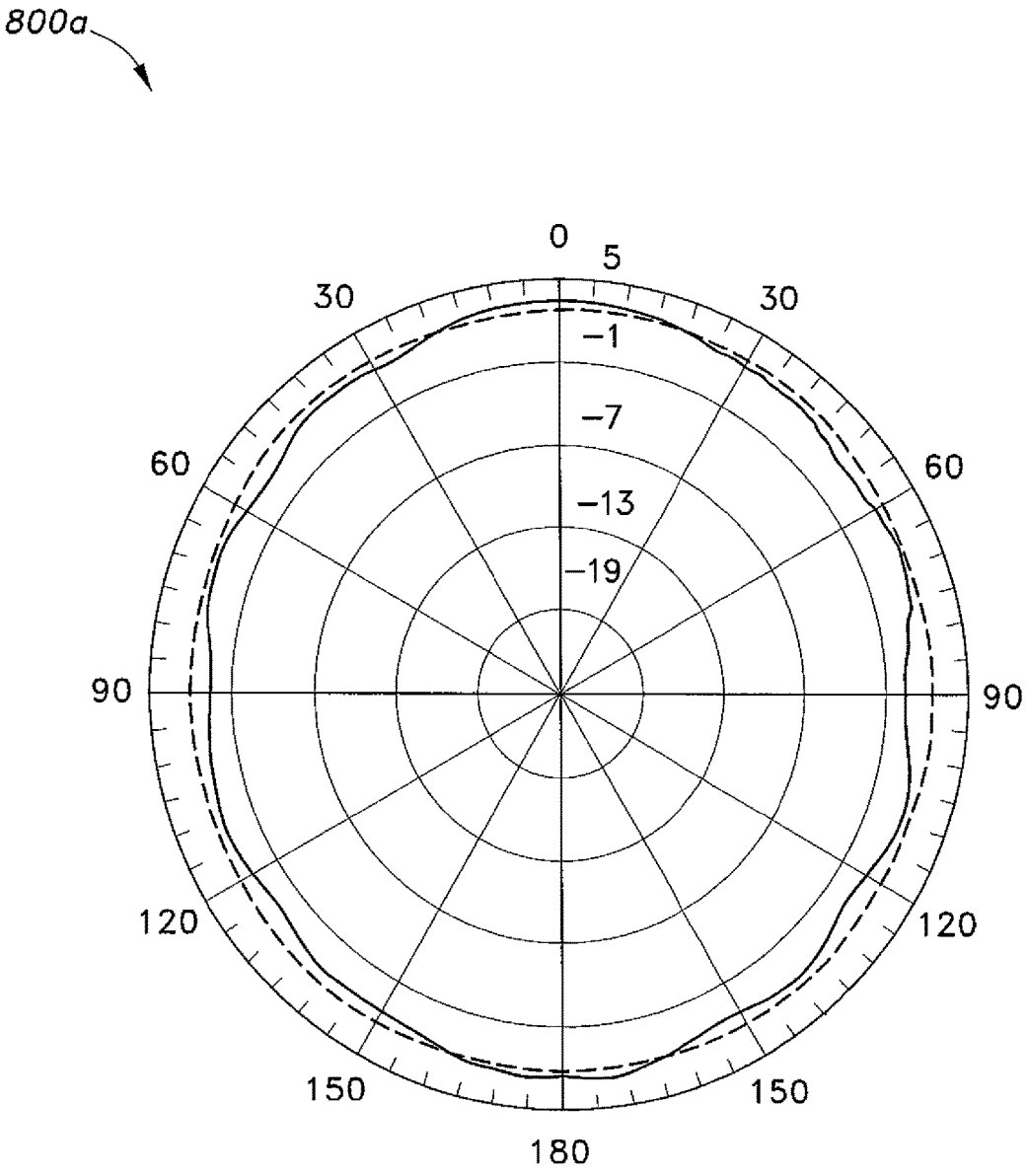
FIG. 8A is a plot showing 2-D gain pattern of the UWB sensing antenna in the yz-plane at a frequency of 800 MHz in a reconfigurable MIMO and sensing antenna system according to the present invention.
Figure 8B:
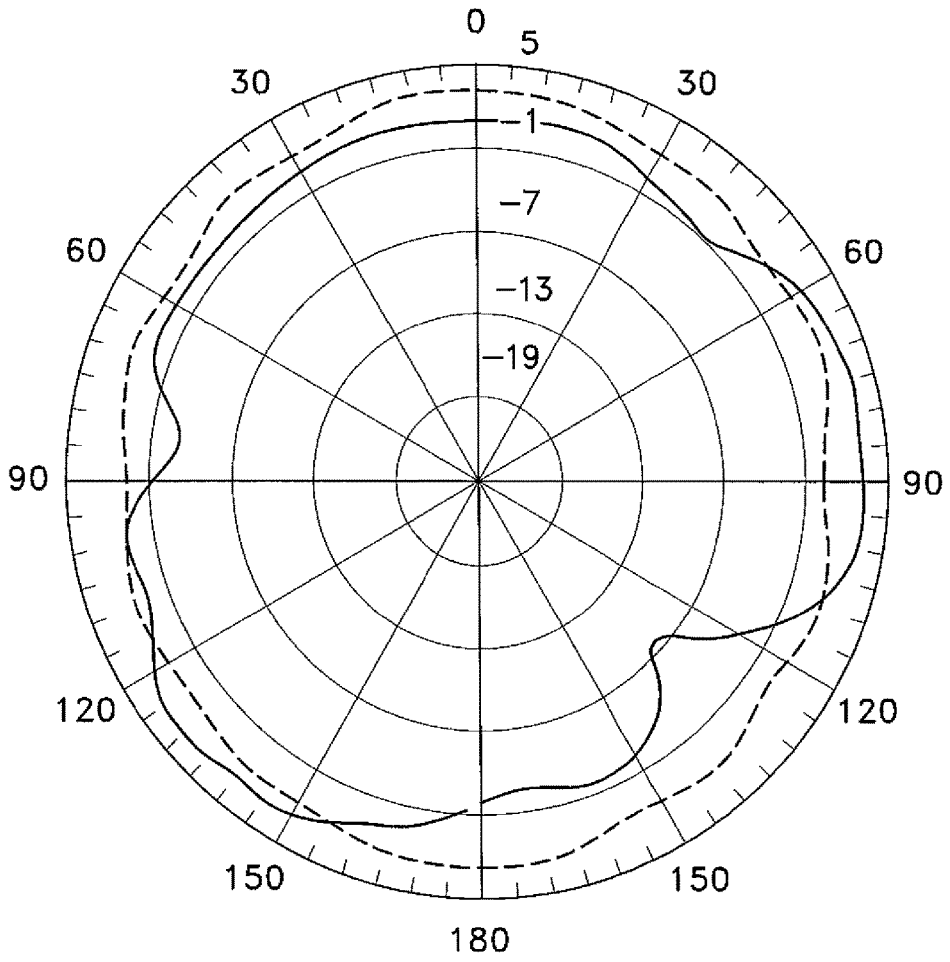
FIG. 8B is a plot showing 2-D gain pattern of the UWB sensing antenna in the yz-plane at a frequency of 1500 MHz in a reconfigurable MIMO and sensing antenna system according to the present invention.
Figure 9:
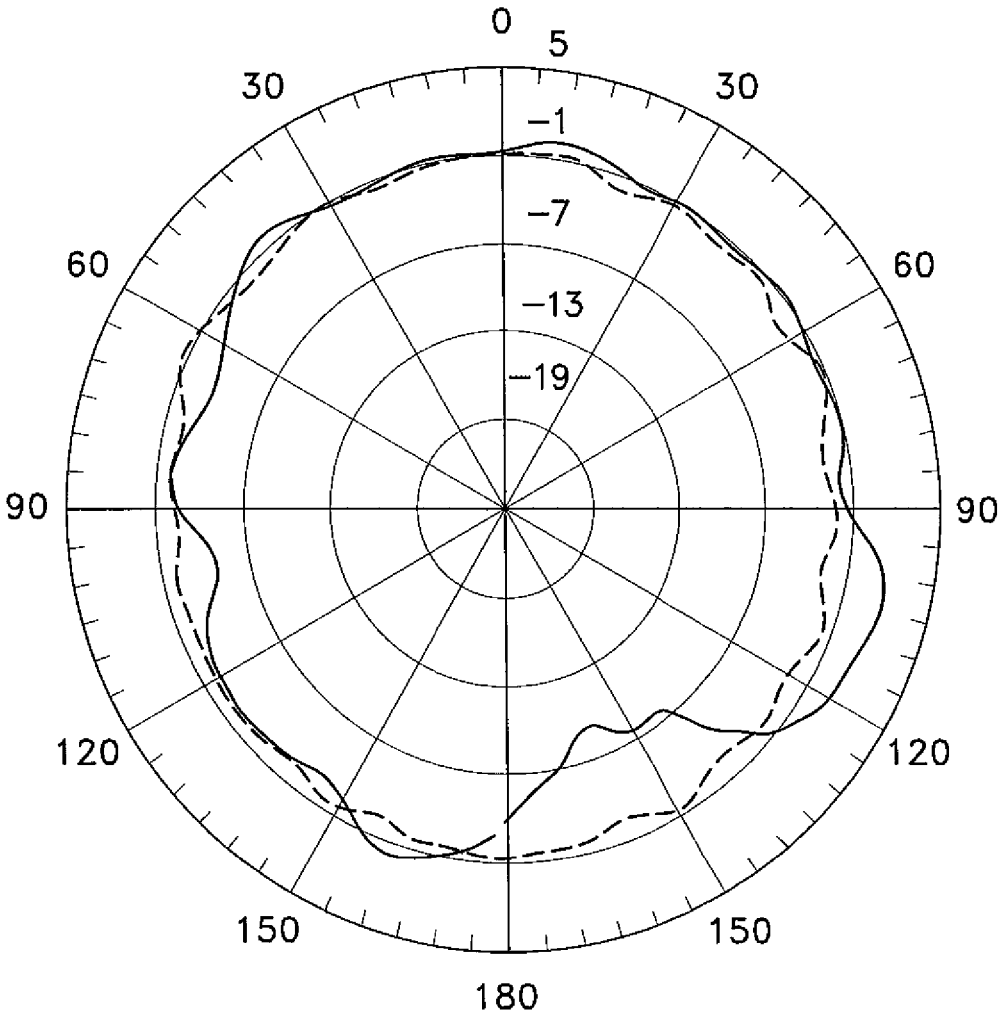
FIG. 9 is a plot showing 2-D gain pattern of the sensing antenna in the yz-plane at a frequency of 3000 MHz in a reconfigurable MIMO and sensing antenna system according to the present invention.

The sensing antenna design presented covers frequency bands from 720-3440 MHz. The simulated and measured reflection coefficients for the sensing antenna 11 are shown in plot 700 of FIG. 7. The measured results for the fabricated antenna are in close agreement with the simulated ones. The basic requirement of the sensing antenna 11 is its omnidirectional radiation pattern for CR applications. The 2-D gain patterns of the sensing antenna 11 in the yz-plane at three different frequencies (800 MHz, 1500 MHz and 3000 MHz) are shown in plots 800*a*, 800*b*, and 800*c* of FIGS. 8A, 8B, and 9, respectively. At all these bands, the sensing antenna 11 exhibits omnidirectional radiation patterns. The simulated 3D gain patterns at three different frequencies (800 MHz, 1500 MHz and 3000 MHz) were demonstrated to have simulated and measured (simulated, measured) peak gain values of (2.26, 2.82), (4.33, 3.83) and (4.26, 4.48) in dBi, while percent efficiencies (% η) were (80, 70), (85, 75) and (92, 79).

The present reconfigurable MIMO antenna system 100*a* is a meander line structure with two slots to connect the PIN and varactor diodes. The given structure is short circuited on one end with the reference GND plane by shorting walls (shown in FIG. 3B). The first discontinuity in the antenna structure is loaded with PIN diodes to connect the radiating parts. The second slot is integrated with a varactor diode to vary the operating frequency smoothly, especially in the lower frequency bands. The PIN diodes were used to switch the frequency bands. The ON/OFF operation of the PIN diodes results in two modes of operation, mode-1, and mode-2, The modes are described as follows.

Figure 10:
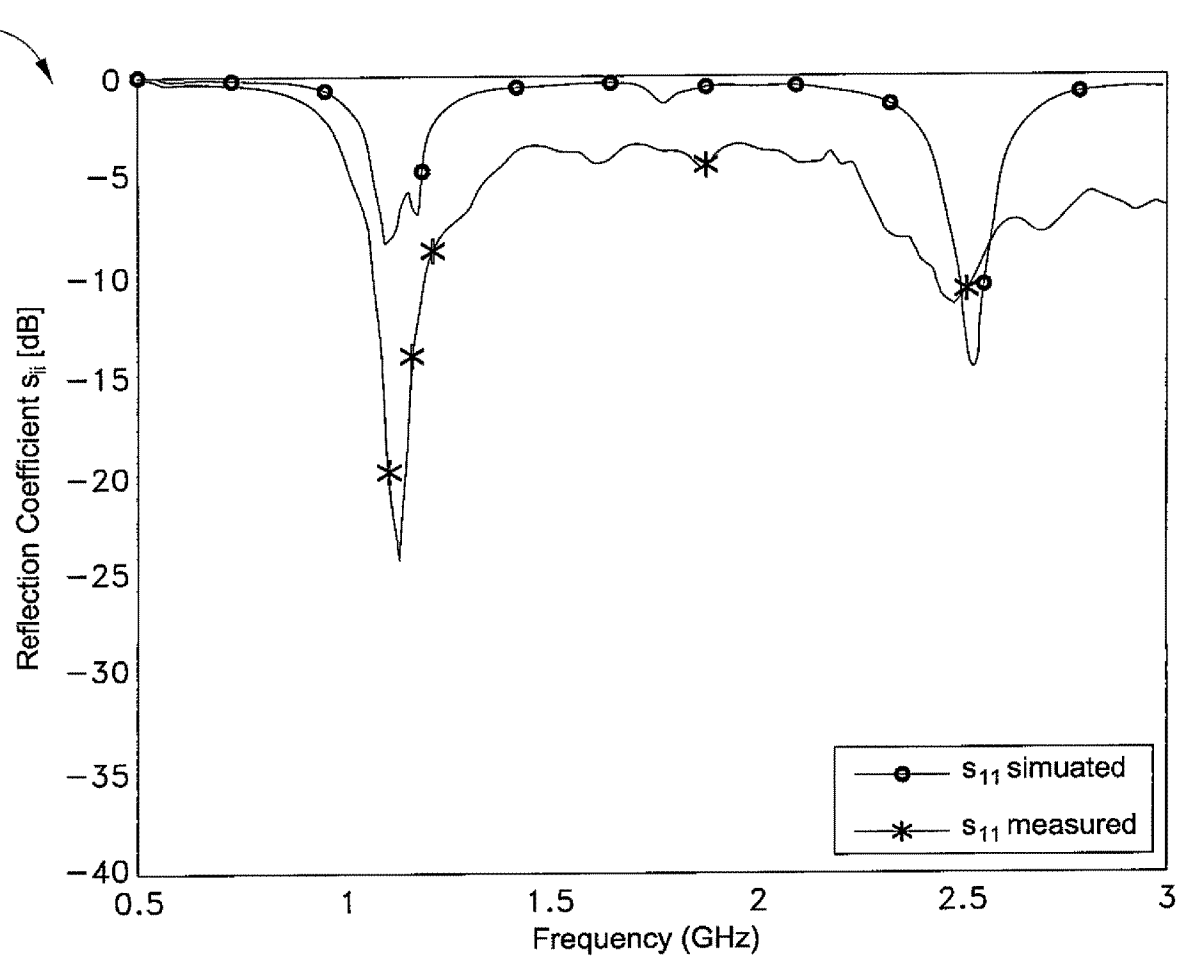
FIG. 10 is a reflection coefficient plot of the antenna circuit showing simulated vs measured s11 in a reconfigurable MIMO and sensing antenna system according to the present invention.

In mode-1, the PIN diodes are switched via reverse biasing to an OFF configuration. The capacitance of the varactor diode was varied, but it had negligible effect on the operating frequency. The resulting simulated and measured reflection coefficients of mode-1 are shown in plot 1000 of FIG. 10. In mode-1, two resonating bands were achieved. The first frequency band was 1100 MHz, while the second resonating frequency was 2480 MHz, with a −6 dB operating bandwidth of at-least 100 MHz in both bands.

In mode-2, the PIN diodes are switched via forward biasing to an ON configuration, while the varactor diodes were biased with voltage from 0-6 volts. The change in capacitance of the varactor resulted in a smooth transition of the operating frequencies. In mode-2, three resonating bands were achieved with center frequencies 585 MHz, 860 MHz and 2410 MHz for zero biasing voltage across the varactor diode. Increasing the biasing voltage results in smooth variation of the operating frequency for the lower two bands, while the biasing voltage had less effect on the upper frequency band. The first resonating frequency was varied between 573-680 MHz while the second band covered 834-1120 MHz. The minimum −6 dB operating bandwidths for the three bands were 22 MHz, 90 MHz and 120 MHz, respectively.

Figure 11:
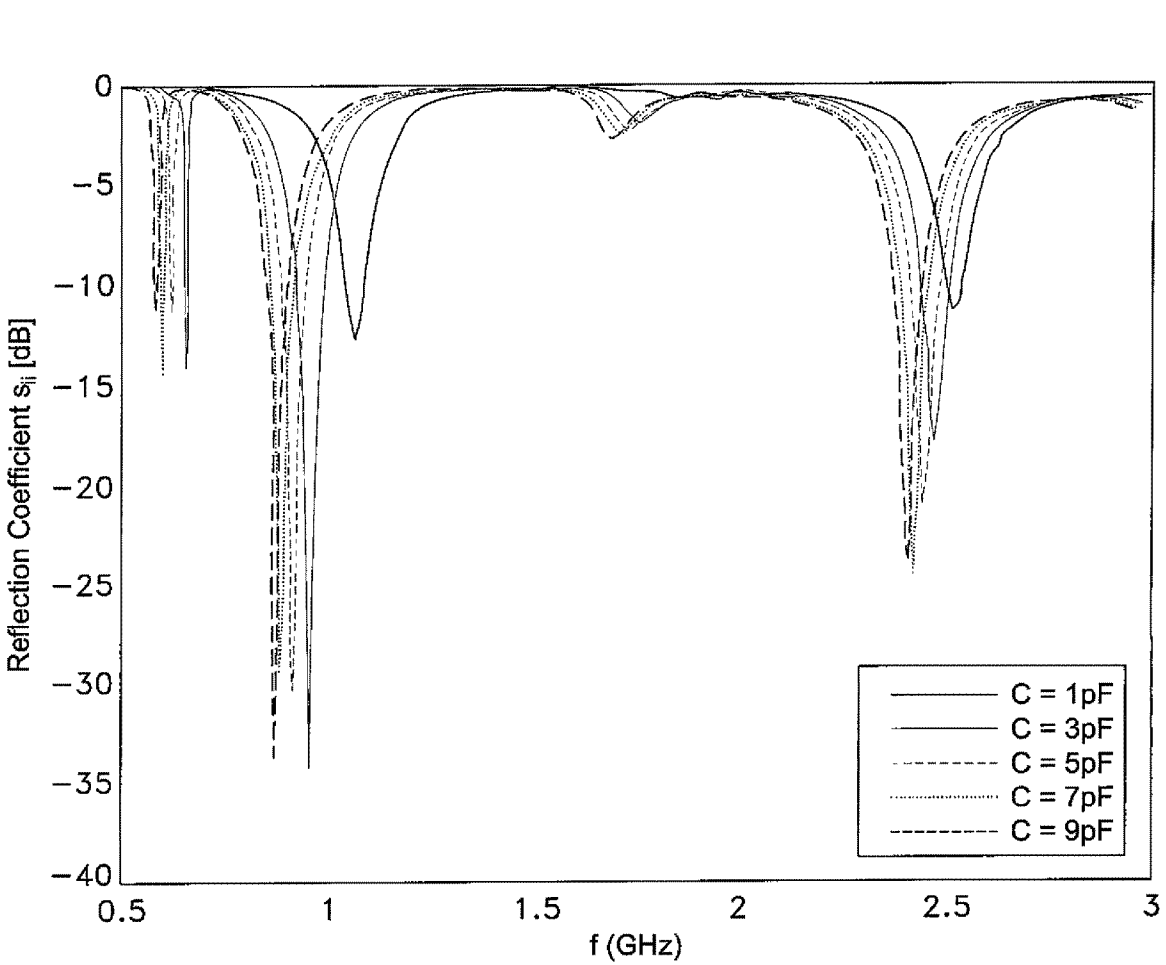
FIG. 11 is a simulated reflection coefficients plot given an alternative variety of capacitances of the antenna circuit in a reconfigurable MIMO and sensing antenna system according to the present invention.
Figure 12:
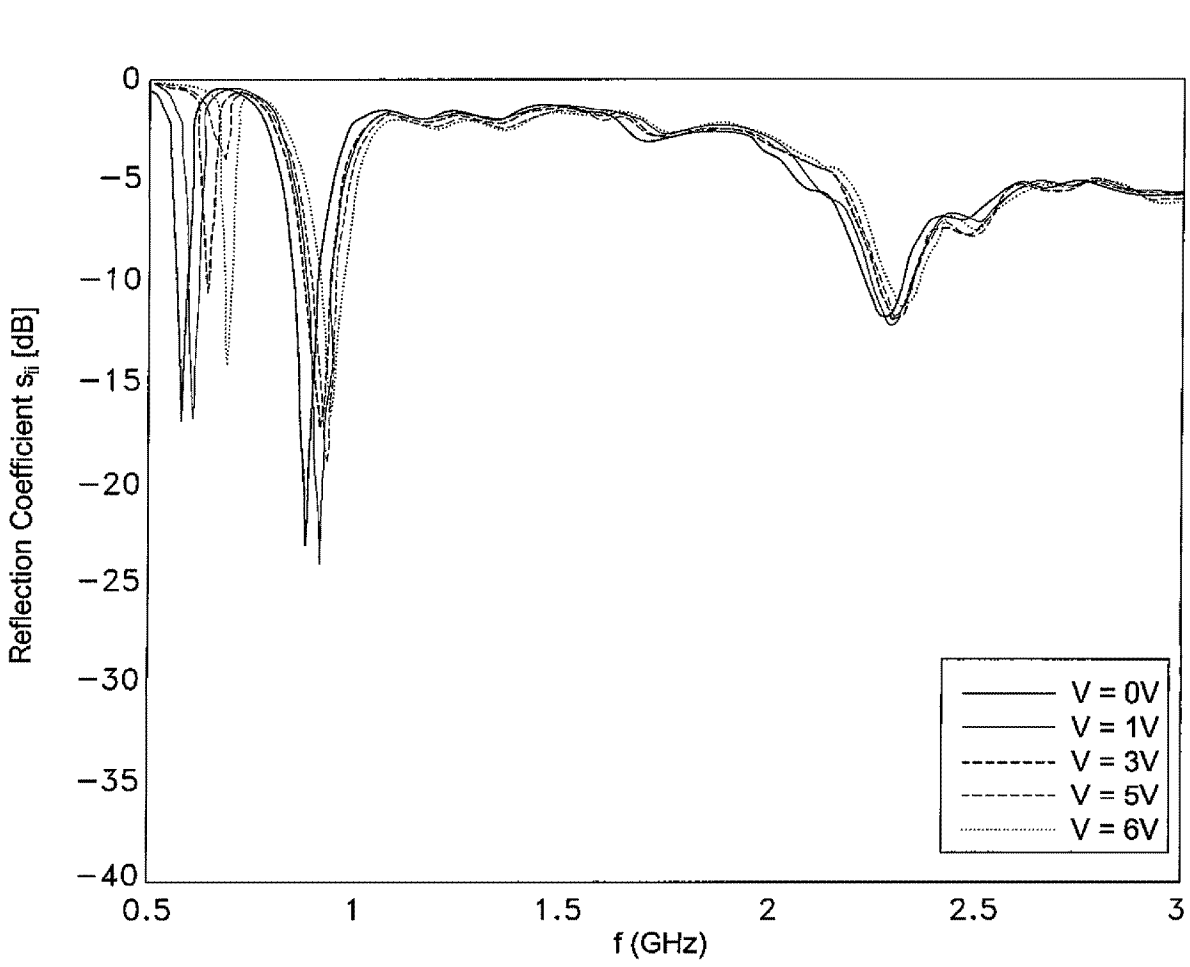
FIG. 12 is a measured reflection coefficients plot given an alternative variety of voltages of the antenna circuit in a reconfigurable MIMO and sensing antenna system according to the present invention.
Figure 13:
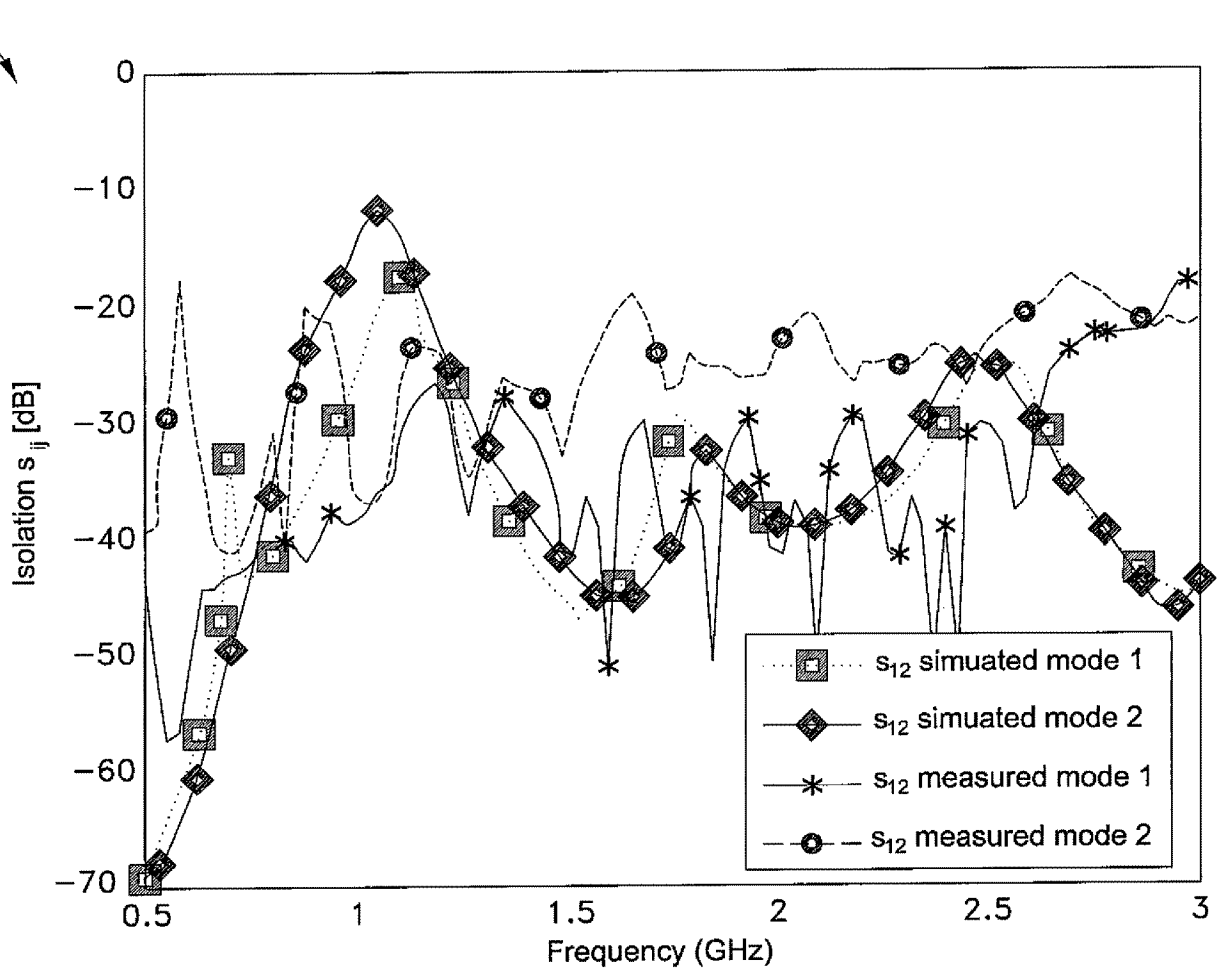
FIG. 13 is a plot showing simulated and measured isolation curves between the MIMO antenna elements in a reconfigurable MIMO and sensing antenna system according to the present invention.

The simulated reflection coefficients are shown in plot 1100 of FIG. 11 for mode-2, while measured reflection coefficients are shown in plot 1200 of FIG. 12. The simulated and measured isolation curves between the MIMO antenna elements are shown in plot 1300 of FIG. 13. The worst case isolation was 11.5 dB between the MIMO antenna elements for both simulated and measured values. The measured isolation between the sensing and communication antennas was more than 15.5 dB for all bands of operation. The simulated and measured results are in close agreement, as evident from the reflection coefficients curves. The slight frequency shift was because of the substrate properties and fabrication tolerances.

Figure 5:
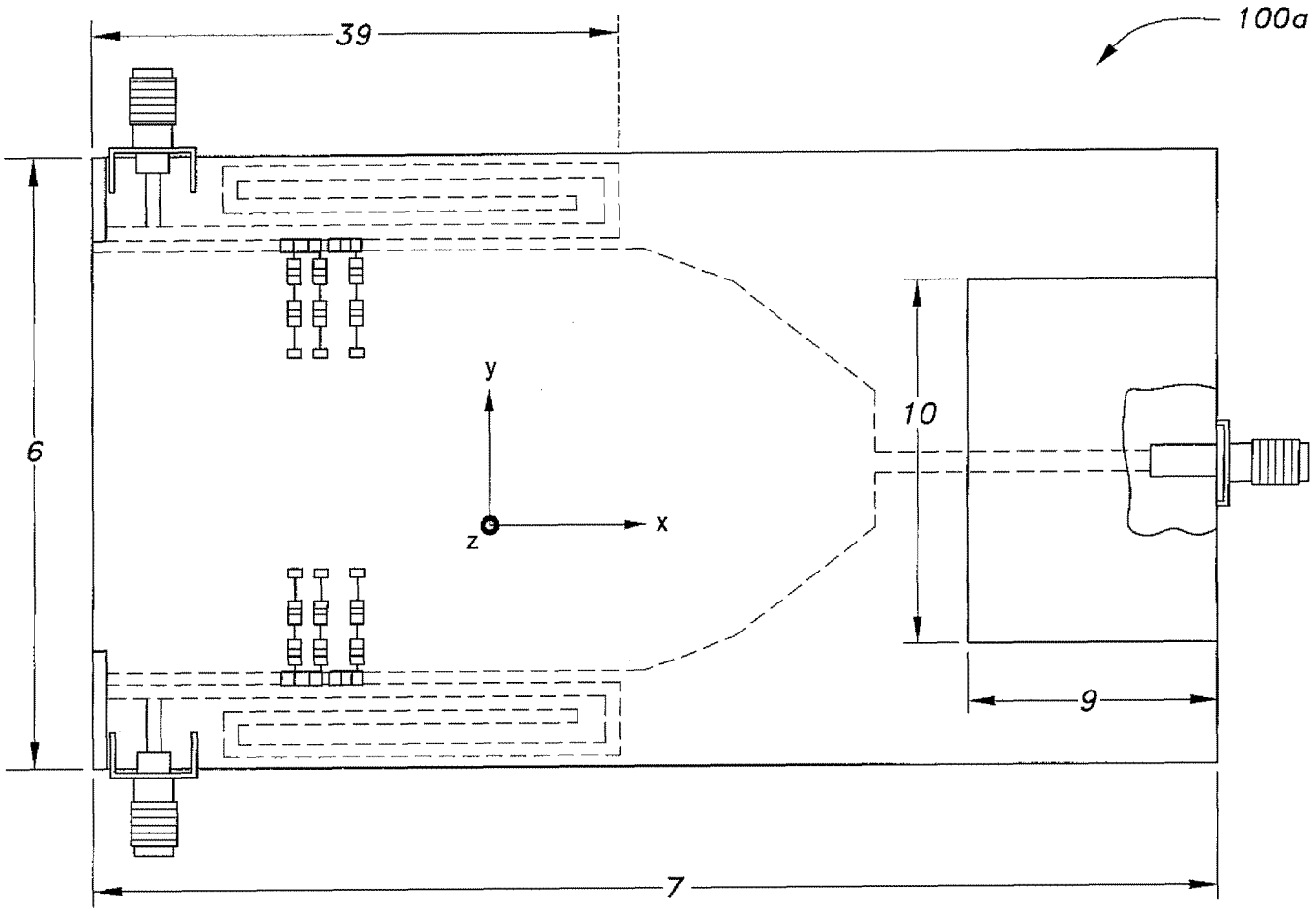
FIG. 5 is a top view of a reconfigurable MIMO and sensing antenna system according to the present invention.
Figure 6:
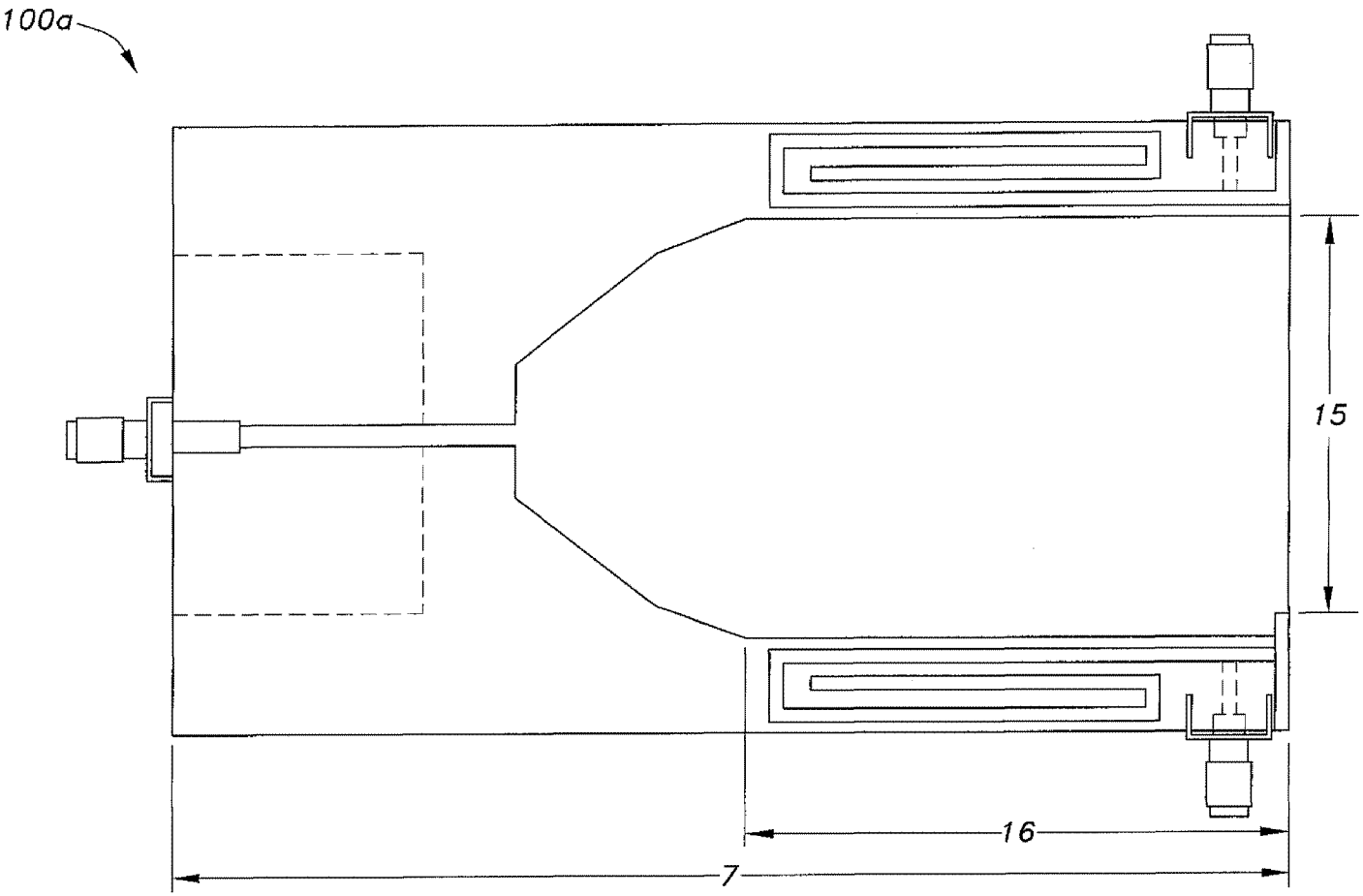
FIG. 6 is a bottom view of a reconfigurable MIMO and sensing antenna system according to the present invention.

The 3D gain patterns of the proposed reconfigurable MIMO antenna system were computed using HFSS™. The 3D gain patterns were computed for two bands: 1100 MHz and 2480 MHz. The fabricated model of the present design 100*a* is shown in FIGS. 5, and 6. FIG. 5 shows top view of the complete 2-element MIMO antenna system 100*a* integrated with a UWB sensing antenna.

It is to be understood that the present invention is not limited to the embodiments described above, but encompasses any and all embodiments within the scope of the following claims.

We claim:

1. A reconfigurable multiple-input-multiple-output (MIMO) and sensing antenna system, comprising:

a planar, rectangular dielectric substrate having opposing long peripheral edges and opposing short peripheral edges, and having a top surface and a bottom surface;

a first and a second Planar Inverted-F antenna (PIFA) element disposed on the top surface of the dielectric substrate, each of the PIFA elements having an F-head portion defining two arms extending to one of the long peripheral edges, respectively, of the rectangular dielectric substrate, and each of the PIFA elements having an F-tail portion extending from the same short peripheral edge of the rectangular dielectric substrate, a meander pattern of conducting material extending from a bottom region of the F-tail portion of each of the PIFAs the first PIFA element and the second PIFA element being mirror images of each other, each of the PIFA elements further having:

three diode circuits, each of the diode circuits having a positive-intrinsic-negative (PIN) diode in series with a varactor diode, each of the diode circuits being disposed on the dielectric substrate's top surface connecting to and extending away from the F-tail portion of the PIFA element, thereby creating separate radiating branches of the PIFA element; and a feed connector connected to one of the F-head portion arms;

an ultra-wide band (UWB) sensing element disposed on the bottom surface of the rectangular dielectric substrate;

a ground plane element for the UWB sensing element, the ground plane element being disposed on the top surface of the rectangular dielectric substrate;

shorting elements extending from the F-head portion of each of the PIFA elements to the UWB sensing element, the UWB sensing element also providing a reference ground plane for the first and second PIFA elements;

wherein the PIN diodes switch the diode circuits across the PIFA radiating branches, the UWB sensing element senses band availability, and the variable capacitance (varactor) diodes fine tune the first and second PIFA elements.

2. The reconfigurable MIMO and sensing antenna system according to claim 1, wherein each of said three diode circuits has a bias circuit defining a first loop, including:

a first fixed resistance and a first fixed radio frequency (RF) choke connected in series to an anode of the PIN diode;

a second fixed resistance and a second fixed radio frequency (RF) choke connected in series to a cathode of the PIN diode; and a fixed DC voltage having a positive terminal connected to the first fixed resistance and a negative terminal connected to the second fixed resistance, thereby closing the first loop.

3. The reconfigurable MIMO and sensing antenna system according to claim 2, wherein the bias circuit of each of said three diode circuits defines a second loop, wherein the second fixed resistance and the second fixed radio frequency (RF) choke connected in series to an anode of the varactor diode, the second loop including:

a third fixed resistance and a third fixed radio frequency (RF) choke connected in series to a cathode of the varactor diode; and a variable DC voltage having a positive terminal connected to the third fixed resistance and a negative terminal connected to the second fixed resistance, thereby closing the second loop.

4. The reconfigurable MIMO and sensing antenna system according to claim 3, further comprising DC blocking capacitors connected as coupling capacitors across each of the separate radiating branches of the first and second PIFA elements.

5. The reconfigurable MIMO and sensing antenna system according to claim 4, wherein the antenna system is configured in a first mode in which the PIN diode is in a reverse-biased "OFF" configuration, resulting in two resonating bands.

6. The reconfigurable MIMO and sensing antenna system according to claim 5, wherein the two resonating bands comprise a first frequency band at 1100 MHz and a second frequency band at 2480 MHz.

7. The reconfigurable MIMO and sensing antenna system according to claim 4, wherein the antenna system is configured in a second mode in which the PIN diode is in a forward biased "ON" configuration, resulting in three resonating bands.

8. The reconfigurable MIMO and sensing antenna system according to claim 7, wherein the three resonating bands include a first frequency band having a center frequency of 585 MHz, a second frequency band having a center frequency of 860 MHz, and a third frequency band having a center frequency of 2410 MHz.

9. The reconfigurable MIMO and sensing antenna system according to claim 6, wherein the varactor diode is in a biased configuration with voltage from 0-6 volts.

* * * * *